United States Patent [19]

Tsukii

[11] 4,346,355

[45] Aug. 24, 1982

[54] RADIO FREQUENCY ENERGY LAUNCHER

[75] Inventor: Toshikazu Tsukii, Santa Barbara, Calif.

[73] Assignee: Raytheon Company, Lexington, Mass.

[21] Appl. No.: 207,559

[22] Filed: Nov. 17, 1980

[51] Int. Cl.[3] ..... H01P 5/08

[52] U.S. Cl. ..... 333/33; 333/34; 333/260

[58] Field of Search ..... 333/33, 34, 260

[56] References Cited

U.S. PATENT DOCUMENTS

| | | | |
|---|---|---|---|
| 3,201,721 | 8/1965 | Voelcker | 333/33 |
| 3,539,966 | 11/1970 | Logan | 339/17 |
| 3,553,607 | 1/1971 | Lehrfeld | 333/34 |
| 3,622,915 | 11/1971 | Davo | 333/34 |
| 4,125,308 | 11/1978 | Schilling | 339/17 LC |
| 4,280,112 | 7/1981 | Eisenhart | 333/34 X |

FOREIGN PATENT DOCUMENTS

| | | | |
|---|---|---|---|
| 2062963 | 7/1971 | Fed. Rep. of Germany | 333/33 |

*Primary Examiner*—Paul L. Gensler
*Attorney, Agent, or Firm*—Denis G. Maloney; Richard M. Sharkansky; Joseph D. Pannone

[57] ABSTRACT

A radio frequency energy launcher providing efficient energy transfer between a coaxial transmission line having spaced inner and outer conductors and a microstrip transmission line comprising a first relatively thin strip conductor and second wider ground plane conductor separated by a dielectric substrate. The launcher includes a conductive housing providing a passageway forming an outer conductor and a spaced inner conductor angled with respect to the passageway outer conductor forming wall and a surface of the substrate. Such angled inner conductor having an end region connected to the coaxial transmission line and having the other end interconnected to the thin strip conductor of the microstrip transmission line. The inner conductor is angled acutely and/or obliquely to such housing wall and a surface of dielectric substrate. The launcher structure is mounted on an extension of the wider ground plane conductor of the microstrip transmission line thus permitting the utilization of a substantially thinner ground plane conductor member while assuring firm mechanical contact with the thin strip conductor microstrip transmission line. The angularly orientated launcher provides for maintaining constant impedance in the transformation of electromagnetic energy fields from a concentric coaxial line distribution to a concentrated eccentric configuration for microstrip line transmission.

8 Claims, 9 Drawing Figures

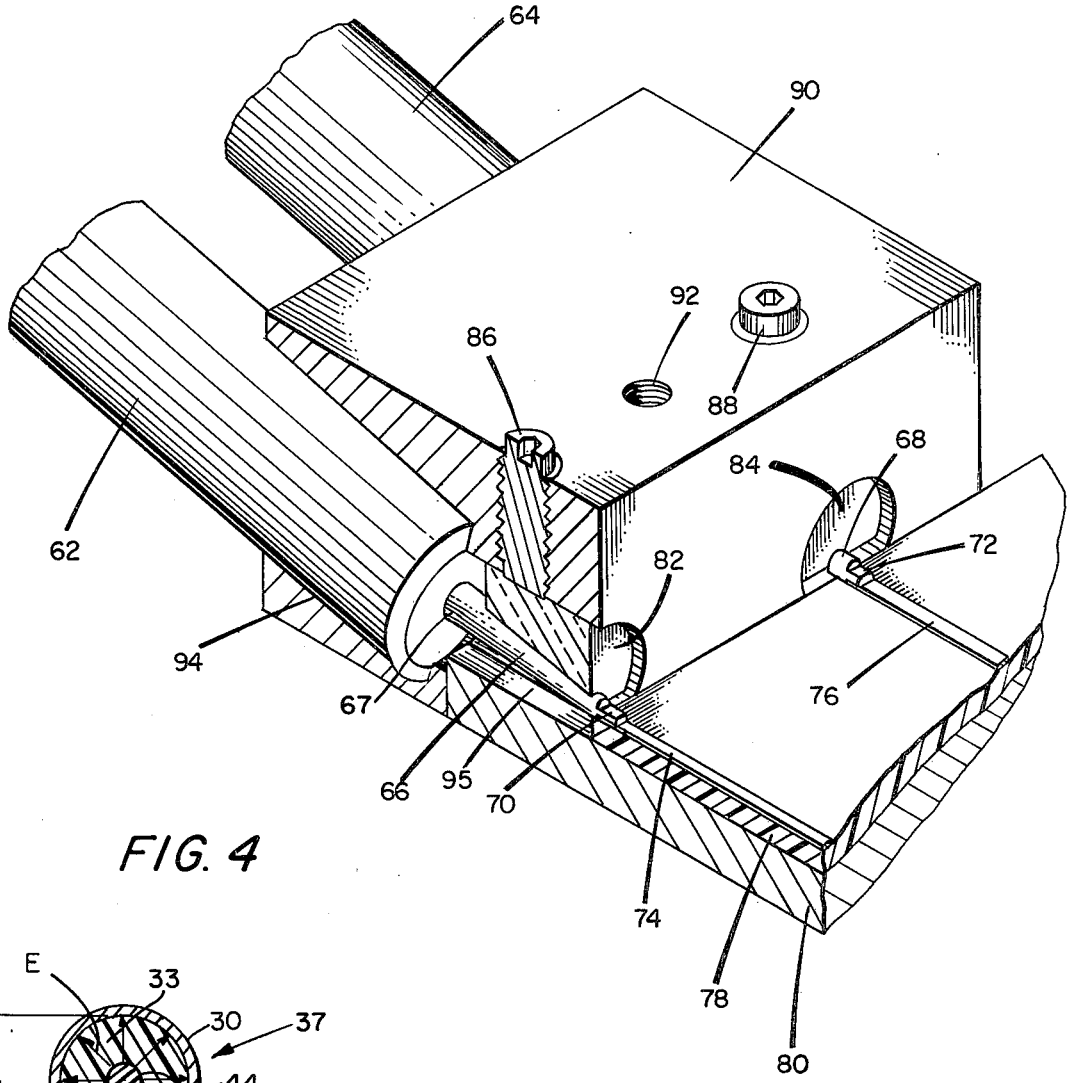
FIG. 4
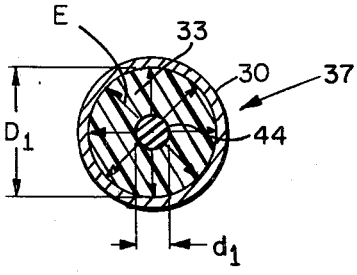
FIG. 6A
FIG. 6B
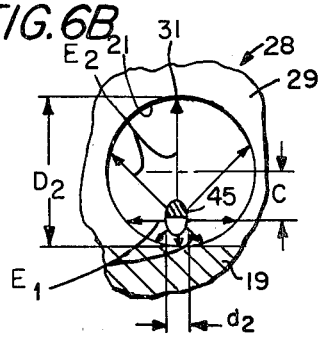
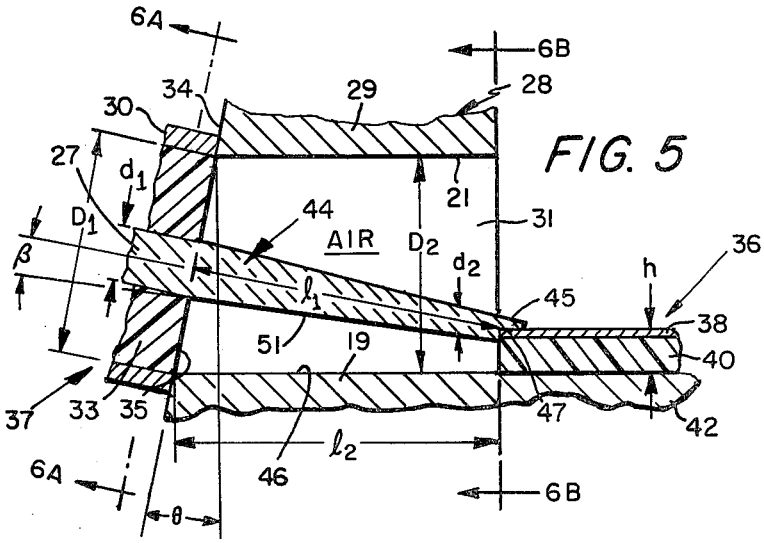
FIG. 5

RADIO FREQUENCY ENERGY LAUNCHER

BACKGROUND OF THE INVENTION

The invention relates generally to radio frequency energy launchers and, more particularly, to such devices for coupling a coaxial transmission line to a microstrip transmission line.

As is known in the art one technique used to connect a coaxial transmission line to a microstrip transmission line is to provide the outer conductor of the coaxial transmission line with a flange vertically secured to an end of the microstrip transmission line and electrically connected to a relatively thick ground plane conductor of the microstrip transmission line. The inner conductor of the coaxial transmission line has its end directly connected to the strip conductor of the microstrip transmission line. Thus, as shown in FIG. 1, the coaxial transmission line 18 includes an outer conductor 20 integrally formed with the flange 22 and an inner conductor 24 spaced from, and coaxial with, the outer conductor 20, as shown. Microstrip transmission line 10 includes a dielectric 14 separating a strip conductor 12 and a ground plane conductor 16, as shown. With such structure, the cantilever type attachment of the flange 22 to the microstrip ground plane 16 necessitates the use of a substantially thicker ground plane conductor for the microstrip transmission line. Further, the end of the inner conductor 24 of the coaxial line 18 has a tendency to lift vertically from engagement with the microstrip strip conductor 12 when the flange 22 is tightened, by screw means 26, to the ground plane conductor 16. Other mechanical problems arise due to the fact that the inner conductor 24 is generally so fragile that it may break when an attempt is made to provide a tight mechanical contact with the strip conductor 12 of the microstrip transmission line.

A major electrical problem of such arrangement is attributed to electromagnetic field discontinuities at the interface between the microstrip transmission line and the coaxial transmission line.

Another prior art structure is described in U.S. Pat. No. 3,622,915 issued Nov. 23, 1971 to Davo comprising an electrical coupler having a horizontal inner and a horizontal outer conductive member which have a cross section at one end identical to that of a coaxial transmission line and a cross section at the other end including a pair of spaced straight lines for connection to spaced conductive strips of microstrip transmission line. A ramplike conductive member disposed within the coupler outer conductive member has a smaller end terminating at the coaxial transmission line end and a larger end terminating adjacent to the microstrip transmission line. The horizontal inner conductive member of the coupler terminates in a springlike member for attachment to the thin strip conductor of the microstrip transmission line. The structure is relatively complicated to fabricate and there is an absence of positive mechanical contact means to interconnect to the thin microstrip conductor without soldering the interconnected components which is more difficult to achieve, particularly, at higher frequencies, such as $K_u$ band.

SUMMARY OF THE INVENTION

It is an object of the invention to provide an improved radio frequency energy launcher for transferring energy between a coaxial transmission line having spaced inner and outer coaxial conductors and a microstrip transmission line having a spaced first thin and second wider ground plane strip conductors separated by a dielectric substrate. In a preferred embodiment of the invention this and other objects are generally attained by providing a radio frequency energy launcher connecting the terminal ends of the coaxial and microstrip transmission lines. Such launcher comprises a conductive housing having a passageway with the wall thereof forming an outer conductor and a spaced, inner conductor disposed within the passageway. The launcher is configured so that the input and output impedances of the launcher are substantially matched to each other. Such arrangement is provided in one embodiment by connecting the launcher inner conductor to a conventional coaxial inner conductor and disposing the launcher inner conductor at an angle relative to the housing passageway wall and a surface of the dielectric substrate to contact the thin strip conductor of the microstrip line. With such angular orientation the launcher inner conductor is terminated on the same plane as the microstrip circuit and the launcher housing is directly mounted on an extension to the ground plane conductor. A relatively thin ground plane conductor can then be employed. The energy transformation provided by the launcher also improves electromagnetic field continuity and provides uniform impedance matching between the coaxial and microstrip transmission lines.

An alternative embodiment of the invention to achieve the desired energy transfer with improved mechanical launcher coupling structure is disclosed including a spaced, inner conductor of constant diameter disposed within an outer conductor forming a passageway at an angle with respect to such outer conductor wall and a surface of the microstrip line substrate. With both an acute and/or oblique angular configuration high density microstrip system packaging is permitted along with improved mechanical and electrical performance.

A further embodiment of the invention incorporates plural or singular receptacles for, illustratively, coaxial cable in the conductive housing adjacent to the entrance to the passageway with the outer conductor of the coaxial transmission line contacting the receptacle walls to provide electrical continuity as well as the angular and/or oblique configuration of the launcher inner conductor which directly interconnects to the microstrip line first thin strip conductor.

In preferred embodiments of the invention a nonconductive contact member under mechanical pressure is disposed within the passageway and has wall structure to firmly engage and conform to both the launcher inner conductor and passageway wall to maintain the angular conductor orientation as well as assist in impedance matching between the coaxial and microstrip transmission lines.

BRIEF DESCRIPTION OF THE DRAWINGS

The aforementioned and other features of the invention will become more apparent by reference to the following description taken together in conjunction with the accompanying drawings wherein like reference numerals designate similar parts throughout the following described views:

FIG. 4 is a perspective view, partly in cross section, of a preferred embodiment of the invention, similar to that shown in FIG. 3, for dual coaxial cable applications taken along the line 4—4 in FIG. 8;

FIG. 5 is a diagrammatic presentation of the energy launcher parameters for use in understanding the invention and deriving some of the important energy launcher specifications;

FIGS. 6A and 6B are diagrammatical views of the electromagnetic field distribution at the end of the launcher adjacent to the coaxial line, taken along line 6A—6A in FIG. 5 and end of the launcher adjacent to the microstrip line, taken along line 6B—6B in FIG. 5;

DESCRIPTION OF THE PREFERRED EMBODIMENT

Figure 1:
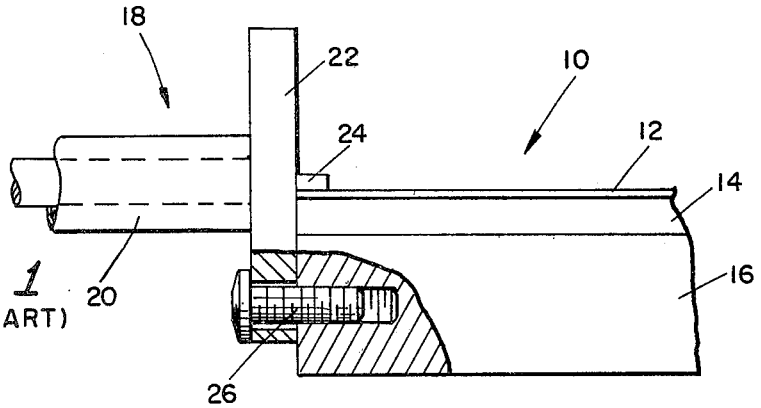
FIG. 1 (PRIOR ART)
FIG. 1 is a side view, partially in cross section, of an illustrative prior art radio frequency energy launcher.

Referring now to FIGS. 2, 5, 6A and 6B, a first radio frequency energy transmission line 37, here a conventional coaxial transmission line having an outer conductor 30 terminating in flange 32 and a symmetrically disposed inner conductor 27 is shown spaced from the terminal end of a second different, radio frequency energy transmission line 36, here a conventional microstrip transmission line 36 having a relatively thin strip conductor 38 separated from a second wider ground strip conductor 42 by a dielectric substrate material 40. The outer coaxial conductor 30 is separated from the inner coaxial conductor 27 by dielectric insulator 33 in the conventional manner. A launcher 28 is disposed between such spaced transmission lines 36, 37 and electrically interconnects the coaxial and microstrip transmission lines 37, 36. Such launcher 28 includes a conductive housing 29 having wall structure 21 providing a passageway 31 forming an outer conductor to mate with outer conductor 30. Bottom portion 46 of housing 29 is mounted on and electrically connected to an extension 19 of ground plane strip conductor 42 of the microstrip transmission line 36. The conductive housing 29 has flange 32, here formed integrally with the outer conductor 30 of coaxial transmission line 37 secured as by screws, to the launcher surface 34.

Launcher 28 includes an inner conductor 44, here formed integrally with the inner coaxial conductor 27 of the coaxial transmission line 37 disposed at an acute angle $\theta$ (FIGS. 2, 3 and 5) with respect to passageway wall 21 and hence at an angle $\theta$ with respect to a surface of substrate 40. Here such angled inner conductor 44 traverses a circular passageway 31 of substantially constant diameter ($D_2$) having an axis parallel to the plane of the ground plane conductor 42, as shown in FIG. 5, to electrically contact thin strip conductor 38 of microstrip transmission line 36. The launcher housing wall 46 is supported on the same plane as ground plane conductor 42 extension 19 and the angled inner conductor 44 is thereby terminated on the same plane as strip conductor 38. Significant, is the fact that the new launcher structure permits utilization of a much thinner ground plane conductor 42 relative to such conductor 16 in FIG. 1. The prior art disadvantages may also be virtually eliminated by reason of fact that screw 52 (FIG. 2) is threaded vertically into housing 29 to secure such housing to extension 19 of ground plane conductor 42. (Screw 52 is shown in phantom since such member does not pass passageway 31). This avoids the end mounting arrangement of FIG. 1 with a longitudinal screw attachment and the disadvantages of cantilever mounting leading to faulty contact.

The electromagnetic field typically associated with coaxial line 37 is substantially concentric and symmetrical and the electric vectors (E) are shown in FIG. 6A while the electric field of the microstrip circuit 36 is concentrated within the dielectric between the strip conductor and the ground plane conductor. It is noted that while the diameter of the portion of the inner conductor 44 of launcher 28 contiguous with the inner conductor 27 of the coaxial transmission line 37 is equal to the diameter of the inner conductor 27, here $d_1$, (FIG. 5) the diameter of the angled inner conductor 44 gradually and continuously tapers down to a smaller diameter, $d_2$, here the width of the strip conductor 38. Further, referring to FIGS. 2, 5 and 6B, the portion 45, 47 of the inner conductor 44 connected to strip conductor 38 is disposed closer to the lower portion 46 of the housing 29 than the upper passageway outer conductor forming wall 21. Therefore, the terminal end 45 connected to the strip conductor 38 is oriented to support a substantially asymmetrical, eccentric electromagnetic field distribution with the higher field concentration located between the strip conductor 38 and ground plane conductor extension 19 as indicated by the electric field vectors $E_1$ in FIG. 6B while the upper portion of the terminal end 45 supports, together with the upper passageway wall portion 21 an elongated or low field concentration, indicated by electric field vectors $E_2$. The effect of the launcher 28 then in addition to providing an improved mounting arangement also is to gradually electrically transform the symmetrical concentric electromagnetic field distribution at the end thereof connected to the coaxial transmission line 37 into an asymmetrical, eccentric electromagnetic field distribution at the end of the launcher 28 connected to the microstrip transmission line 36; such field being more concentrated between the strip conductor 38 and ground plane conductor extension 19 of the microstrip transmission line 36.

Figure 2:
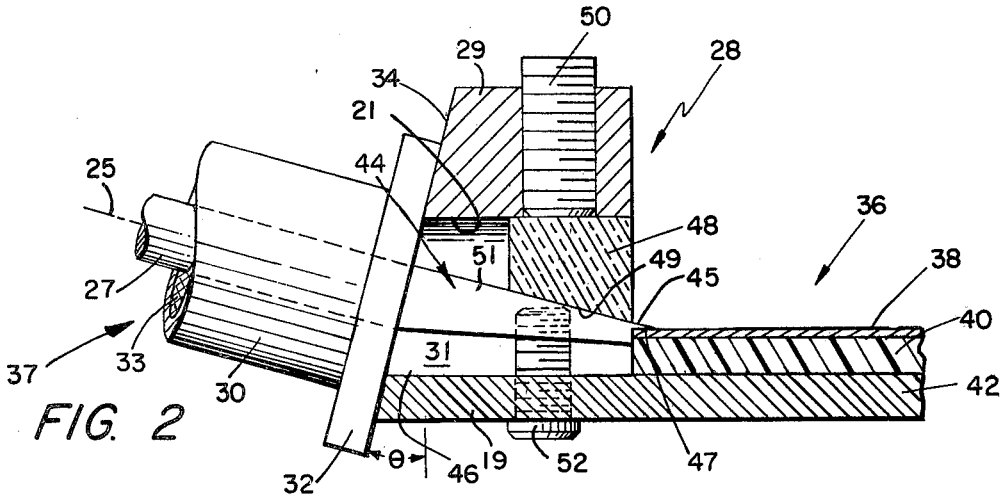
FIG. 2 is a cross-sectional view of a preferred embodiment of the invention.

As shown in FIG. 2 contact member 48 of a dielectric material having a matching tapered wall 49 configuration is disposed within passageway 31 to engage walls 51 of conductor 44. Screw means 50 disposed in housing 29 maintains the contact member 48 in firm mechanical contact with conductor 44 and assures that end portion 45 with notch 47 is mechanically and electrically in contact with strip conductor 38. The impedance matching characteristics of the radio frequency energy launcher 28 including angled conductor 44 (FIG. 2) disposed within passageway 31 are influenced by the composition of contact member 48. Such characteristics may be varied by selection of the dielectric materials. Nylon and ceramic materials have been preferred as exhibiting broad phase and impedance matching characteristics.

Figure 3:
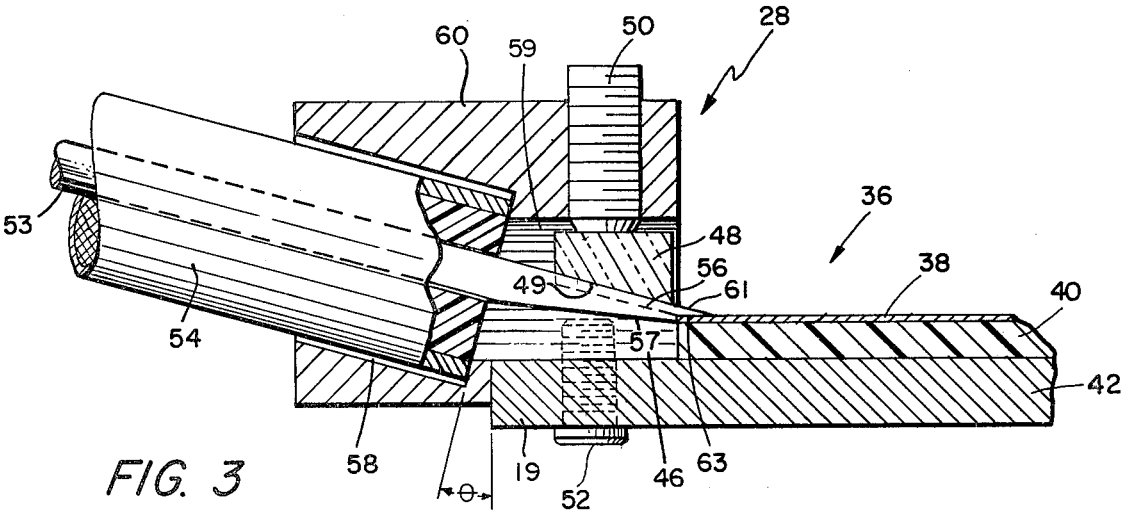
FIG. 3 is a cross-sectional view of an alternative preferred embodiment of the invention.

Referring to FIG. 3, a coaxial line having an inner conductor 53 and outer conductor 54 is shown disposed within a hollow receptacle 58 within the launcher housing 60 angled with respect to a surface of substrate 40 and the outer conductor walls of passageway 59. In accordance with the invention, inner conductor 56 of the launcher integrally associated with inner conductor 53 of the coaxial transmission line defines an acute angle $\theta$ with respect to an edge surface of the microstrip substrate 40, thin strip conductor 38 and passageway wall as in the case of conductor 44 in FIG. 2. The angled inner conductor terminates in end 61. In this embodiment the conductor 54 is inserted within angled receptacle 58 in housing 60 to provide the angular orientation. Again the angled inner conductor 56 is held in firm mechanical contact by insulator 48 and screw 50 in housing 60. The end of the inner conductor 56 is directly connected to the strip conductor 38 which is notched as at 63. The housing 60 is also supported directly on ground plane conductor extension 19 by means of bottom wall 46.

In FIG. 4 juxtapositioned dual coaxial cable outer conductors 62, 64 are disclosed with the terminal ends of the coaxial transmission lines disposed in angled receptacles 94 in housing 90. Launcher inner conductors 66, 68 having the angular configuration extend within passageways 95 and the ends 70, 72 interconnect to thin strip conductors 74, 76 disposed on the top surface of dielectric substrate 78. The walls of passageways 95 comprise the outer conductors of the launcher electrically connected to outer conductor 62, 64 similar to conductors 30, 54 in FIGS. 2 and 3. Inner conductors 66, 68 are maintained in firm electrical contact with strip conductors 74, 76 by dielectric contact members 82, 84 disposed within passageways 95 in housing 90 in a manner similar to that described in connection with FIGS. 2 and 3 for contact member 48. Screws 86, 88 exert a biasing force to maintain this contact. Aperture 92, internally threaded, in housing 90 provides for fastening the launcher to the ground plane conductor 80 of a microstrip transmission line and receives a screw, such as screw 52 in FIGS. 2 and 3.

Figure 7:
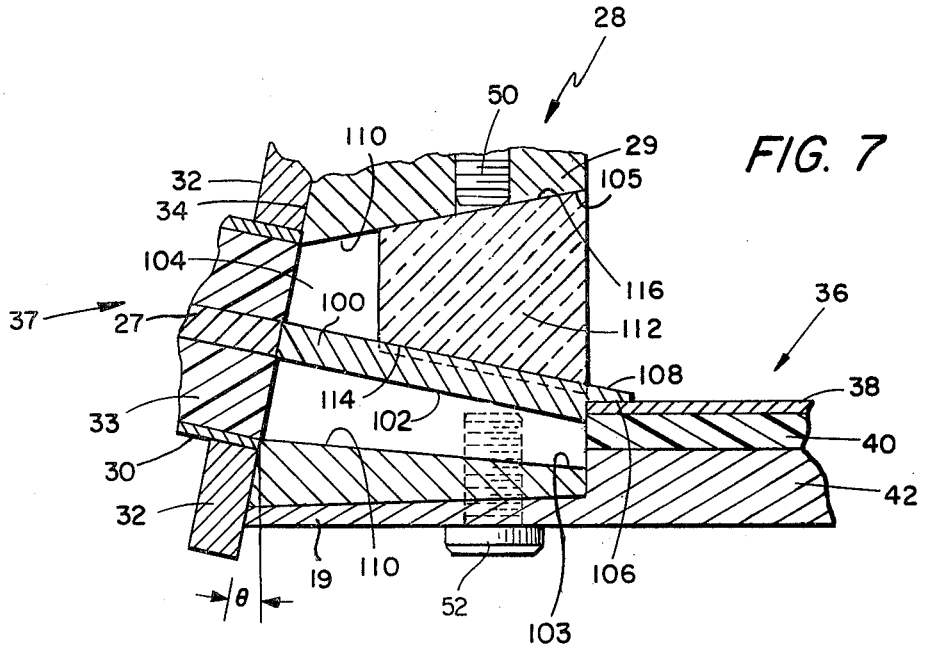
FIG. 7 is fragmentary cross-sectional view of another alternative embodiment of the embodiment of the invention.

Referring now to FIG. 7 an alternative embodiment comprises an inner conductor 100 of constant diameter extending within passageway 104 of launcher 28 at an angle with respect to a surface of the substrate 40 of the microstrip transmission line 36. Walls 110 forming the outer conductor are flared to provide at outer edges 103, 105 a larger diameter adjacent the microstrip transmission line 36. The transformation from the coaxial symmetrical electromagnetic field distribution associated with the coaxial transmission line 37 to the concentrated asymmetrical electromagnetic field distribution associated with the microstrip transmission line 36 is achieved efficiently since inner conductor end 108 will be closer to the lower wall portion 103 of the outer conductor wall 110 of the launcher 28 disposed adjacent to the ground plane extension 19 than the other wall portions of the outer conductor of launcher 28. Conductor 100 has at its terminal end 108 an accommodating notch 106 to engage thin strip conductor 38 and an edge surface of substrate 40. Dielectric contact member 112 having conforming walls 114, 116 to mate with inner conductor 100 and flared wall passageway 110 is positioned by means of screw 50.

Figure 8:
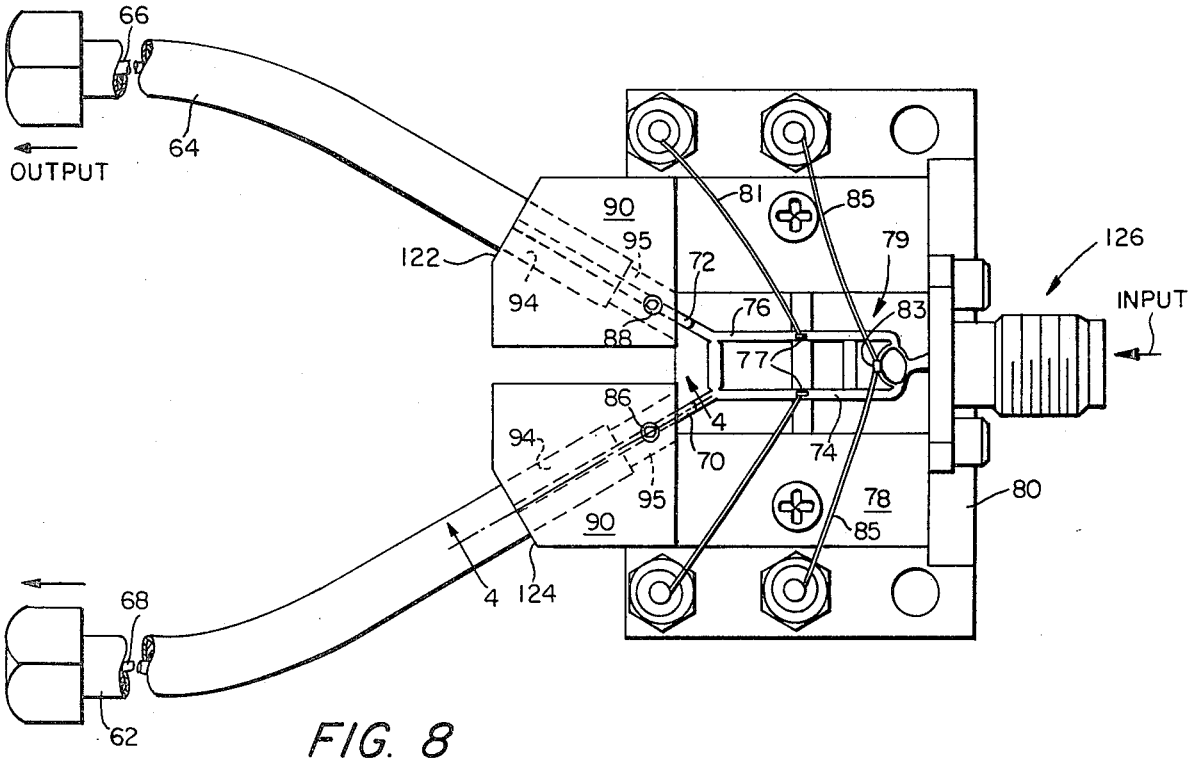
FIG. 8 is a plan elevation view of a dual output microstrip to coaxial transmission line launcher with an angled and oblique inner conductor configuration.

FIG. 8 illustrates dual coaxial inner conductors 66, 68 interconnected to microstrip thin conductors 74, 76 on the top surface of substrate 78 forming hybrid microstrip transmission circuit 79. Such conductors 66, 68 disposed within receptacles 94 are angled with respect to substrate 78 and passageway walls 95 in housing 90 as also shown in FIG. 4. Solid state devices such as FET's 77 are DC biased by wires 81 and PIN diode 83 with DC bias leads 85.

In accordance with the invention the angled launcher conductor orientation may additionally be provided with an oblique or approximately 45° orientation with respect to the edge surface of substrate 78 as shown in FIG. 8. Again the electromagnetic field is concentrated adjacent the tips 70, 72 (FIGS. 4 and 8). Screws 86, 88 bias the dielectric contact members 82, 84, (FIG. 4) to maintain firm electrical contact with respect to strip conductors 74, 76 of microstrip transmission circuit 79. The oblique orientation of the coaxial transmission line conductors 62, 64 and 66, 68 is maintained by means of angled end walls 122, 124 of housing 90 (FIG. 8). The outer conductors 62, 64 terminate within receptacles 94 in housing 90 and are electrically secured to the receptacle walls 94 as well as walls 122, 124. Energy launcher 126 provides for coupling the input of the hybrid microstrip transmission line circuit 79 including PIN diode 83 to external circuitry. The housing 90 is again fastened by means such as screw 52 as shown in FIGS. 2, 3 and 7 to the ground plane conductor 80 to provide the new improved mounting of the invention.

The shape of the passageway wall forming the outer conductor and the inner conductor of the housing is selected to provide the launcher with the same impedance at the input and output end. Thus for a symmetrical, concentric electromagnetic field distribution, as shown with the fields indicated by arrows (E) extending substantially uniformly in all directions in FIG. 6A, the characteristic impedance Zo, may be represented as follows:

$$Zo = \frac{138}{\sqrt{\epsilon}} \log_{10}\left(\frac{D_1}{d_1}\right) \text{ ohms; where} \tag{1}$$

$(D_1)$=inner diameter of outer conductor 30; $(d_1)$=diameter of conductor 44 and $\epsilon$=dielectric constant of dielectric 33.

For an asymmetrical eccentric electromagnetic field concentration, as at terminal end 45 of inner conductor 44 of launcher 28 (i.e. along line 6B—6B in FIG. 5), the impedance may be calculated as follows Where $(d_2)$ is much smaller than the diameter of the circular passageway $(D_2)$ then:

$$Zo = \frac{138}{\sqrt{\epsilon}} \log_{10}\left[\frac{D_2}{d_2}\left(1 - \left(\frac{2C}{D_2}\right)^2\right)\right] \tag{2}$$

Where (C)=distance from center of end 45 to the center of the passageway 31 along the line 6B—6B.

In order to match the impedance at one end of the launcher 28 with the impedance at the other end from eqs. (1) and (2) then:

$$\frac{D_1}{d_1} = \frac{D_2}{d_2}\left[1 - \left(\frac{2C}{D_2}\right)^2\right]; \tag{3}$$

Assuming a constant diameter horizontal passageway $(D_2)$ and angular orientation for the inner conductors of the launchers as shown in FIGS. 2, 3, 4 and 8

$$d_1 = \frac{d_2}{\cos\theta\left[1-\left(\frac{2C}{D_2}\right)^2\right]}; \quad (4)$$

Since in FIG. 6B we note the eccentric field distribution indicates that ($D_2$) is greater than (2C) and Cos $\theta<1$; then dimension ($d_1$) or the center conductor 44 diameter adjacent the coaxial transmission line being greater than the dimension ($d_2$) at the end 45 adjacent to the microstrip transmission line 36.

An analysis with regard to FIG. 7 disclosing another launcher embodiment with a constant diameter ($d_1=d_2$) inner conductor 100 results in the following equation:

$$\frac{D_1}{d_1} = \frac{D_2}{d_1}\left[1-\left(\frac{2C}{D_2}\right)^2\right] \text{; therefore} \quad (5)$$

$$D_1 = D_2\left[1-\left(\frac{2C}{D_2}\right)^2\right]. \quad (6)$$

Where (2C) is less than ($D_2$) this results in the outer conductor structure with ($D_2>D_1$) or the flared wall configuration 110 of passageway 104 shown in such FIG. 7 but with the ends of the inner conductor 100 closer to the lower passageway wall 103 (FIG. 7) than the upper wall portion 105.

The mathematical analysis provided by the equations (1) and (2) will lead a user to the optimum energy transformation with improved impedance matching performance and superior mounting provided with the angular orientation.

There is thus disclosed a preferred embodiment, as well as several alternative embodiments of the present invention. Combinations of the illustrative embodiments involving angular and/or oblique disposition of the inner conductor with respect to the outer conductor wall of the launcher and a surface of the interconnected microstrip transmission line may be realized. While planar and linear configurations have been principally illustrated and described other embodments may also be realized. It is understood that the various modifications and alterations in the disclosed embodiment may be practiced by those skilled in the art without departing from the spirit and scope of the invention as set forth in the appended claims. Therefore, all matter shown and described herein is to be interpreted as illustrative only and not in a limiting sense.

What is claimed is:

1. A radio frequency energy launcher for transferring such energy between a coaxial transmission line having inner and outer spaced, coaxial conductors and a microstrip transmission line having a dielectric substrate, a strip conductor disposed on a surface of the substrate and a ground plane separated from the strip conductor by the dielectric substrate comprising:

a conductive housing having a wall structure providing a passageway forming an outer conductor and a spaced inner conductor extending within said passageway to electrically interconnect said inner conductor of said coaxial transmission line and said strip conductor of said microstrip transmission line;

means for exerting a mounting force between the inner conductor of the coaxial transmission line and the strip conductor of the microstrip transmission line such force having a component normal to the surface of the dielectric substrate; and wherein the launcher inner conductor is disposed at an oblique angle relative to the surface of said dielectric substrate.

2. A radio frequency energy launcher for transferring such energy between a coaxial transmission line having inner and outer spaced, coaxial conductors and a microstrip transmission line having a dielectric substrate, a strip conductor disposed on a surface of the substrate and a ground plane separated from the strip conductor by the dielectric substrate comprising:

a conductive housing having a wall structure providing a passageway forming an outer conductor and a spaced, inner conductor extending within said passageway to electrically interconnect said inner conductor of said coaxial transmission line and said strip conductor of said microstrip transmission line, said outer conductor of said coaxial transmission line being interconnected to said passageway outer conductor forming wall at an acute angle with respect to said microstrip transmission line;

means for exerting a mounting force between the inner conductor of the coaxial transmission line and the strip conductor of the microstrip transmission line such force having a component normal to the surface of the dielectric substrate; and wherein the launcher inner conductor is disposed at an oblique angle relative to said housing passageway wall.

3. A radio frequency energy launcher for transferring such energy between a coaxial transmission line having inner and outer spaced, coaxial conductors and a microstrip transmission line having a dielectric substrate, a relatively thin strip conductor disposed on a surface of the substrate and a wider ground plane conductor separated from the thin strip conductor by the dielectric substrate comprising:

a conductive housing having a wall structure providing a passageway forming an outer conductor adapted for mounting on an extension of said ground plane conductor of said microstrip transmission line and a spaced inner conductor extending within said passageway to electrically interconnect said inner conductor of said coaxial transmission line and said relatively thin strip conductor of said microstrip tranmission line, said outer conductor of said coaxial tranmission line being interconnected to said housing passageway outer conductor forming wall at an acute angle with respect to said microstrip transmission line;

means for exerting a mounting force between the inner conductor of the coaxial tranmission line and the strip conductor of the microstrip transmission line such force having a component normal to the surface of the dielectric substrate; and wherein the launcher inner conductor being disposed at an oblique angle with respect to said housing passageway outer conductor forming wall and a surface of the substrate.

4. A radio frequency energy launcher according to claim 3 wherein said angled obliquely launcher inner conductor is disposed at an acute angle relative to said housing passageway outer conductor forming wall and a surface of said microstrip transmission line.

5. A radio frequency energy launcher according to claim 3 wherein said conductive housing defines a tapered wall adjacent to the entrance to said passageway and the outer coaxial conductor of said coaxial line is terminated at said tapered wall.

6. A radio frequency energy launcher according to claim 3 wherein said angled inner conductor has a substantially constant diameter within said passageway and is disposed at an oblique angle relative to the passageway wall and said passageway has a tapered and flared wall increasing in diameter at the end region proximate to the microstrip transmission line.

7. A radio frequency energy launcher according to claim 3 wherein said conductive housing comprises a receptacle adjacent to the entrance to said passageway, said launcher inner conductor and coaxial transmission line being disposed at an oblique angle relative to said housing passaeway wall and a surface of said substrate of said microstrip and said coaxial outer conductor is electrically contacting the receptacle wall.

8. A radio frequency energy launcher according to claim 3 wherein a dielectric contact member is disposed within said passageway to engage said obliquely angled inner conductor; and screw means disposed through said ground plane of said microstrip tranmission line and in said housing to exert a pressure on said contact member assuring a firm electrical contact between the end region of said obliquely angled inner said conductor and said relatively thin strip conductor of said microstrip transmission line.

* * * * *

UNITED STATES PATENT OFFICE

CERTIFICATE OF CORRECTION

Patent No. 4,346,355 Dated August 24, 1982

Inventor(s) Toshikazu Tsukii

It is certified that error appears in the above-identified patent and that said Letters Patent are hereby corrected as shown below:

Column 7, line 46, delete "embodiment" and replace with --embodiments--;

Column 8, line 62, (Claim 4), delete "angled obliquely" and replace with --obliquely angled--;

Column 9, line 15, (Claim 7), delete "passaeway" and replace with --passageway--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*